US010183777B2

(12) United States Patent
Adams

(10) Patent No.: US 10,183,777 B2
(45) **Date of Patent: *Jan. 22, 2019**

(54) PALLET-SIZED SHIPPING AND DISPLAY TRAY

(71) Applicant: INTERNATIONAL PAPER COMPANY, Memphis, TN (US)

(72) Inventor: Wesley N. Adams, Elk Grove, CA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/895,024

(22) Filed: Feb. 13, 2018

(65) Prior Publication Data

US 2018/0170608 A1 Jun. 21, 2018

Related U.S. Application Data

(62) Division of application No. 15/069,007, filed on Mar. 14, 2016, now Pat. No. 9,926,100.

(60) Provisional application No. 62/136,006, filed on Mar. 20, 2015.

(51) Int. Cl.

| | |
|---|---|
| ***B65D 85/48*** | (2006.01) |
| ***B65D 5/20*** | (2006.01) |
| ***B65D 5/498*** | (2006.01) |
| ***B65D 5/52*** | (2006.01) |

(Continued)

(52) U.S. Cl.

CPC ..... *B65D 5/48048* (2013.01); *B65D 5/20* (2013.01); *B65D 5/321* (2013.01); *B65D 5/322* (2013.01); *B65D 5/4804* (2013.01); *B65D 5/5213* (2013.01)

(58) Field of Classification Search

CPC .. A47F 5/11; A47F 5/114; A47F 5/116; B65D 5/00; B65D 5/006; B65D 5/06; B65D 5/20; B65D 5/32; B65D 5/321; B65D 5/322; B65D 5/48; B65D 5/4804; B65D 5/48048; B65D 5/50

USPC ..... 206/386, 503, 509, 744; 229/120.36, 229/120.37, 199, 915

See application file for complete search history.

(56) References Cited

U.S. PATENT DOCUMENTS

| | | | |
|---|---|---|---|
| 3,203,612 | A | 8/1965 | Schaefer |
| 3,348,667 | A | 10/1967 | Beeby |
| 3,565,320 | A | 2/1971 | Osborne et al. |

(Continued)

*Primary Examiner* — Bryon Gehman

(74) *Attorney, Agent, or Firm* — Matthew M. Eslami; Thomas W. Ryan

(57) ABSTRACT

A pallet-sized shipping and display tray includes a base portion having an interior space and opposed sides ends. The respective spaced-apart first and second vertical columns each of which is configured to be positioned in the opposed ends of the interior space of the base portion. Each of the respective first and second spaced-apart vertical columns includes two shoulder panels, two coterminous spine panels, and two arm panels all of which are foldably joined to one another. At least one deck is configured to be attached to the respective spaced-apart first and second vertical columns to form a bridge. The at least one deck includes a supporting panel having two side depending flanges and two end depending flanges all of which foldably joined to one another so as to adequately support a weight of one or more upper display trays when they are stacked upon one another.

4 Claims, 14 Drawing Sheets

(51) Int. Cl.
*B65D 5/32* (2006.01)
*B65D 5/496* (2006.01)

(56) References Cited

U.S. PATENT DOCUMENTS

| | | | | |
|---|---|---|---|---|
| 4,314,633 | A | 2/1982 | Oliff | |
| 5,115,965 | A | 5/1992 | Girona Alepuz | |
| 5,520,325 | A | 5/1996 | Quaintance | |
| 6,513,705 | B1 | 2/2003 | Sheffer | |
| 6,749,108 | B2 | 6/2004 | Naughton et al. | |
| 7,637,372 | B2 * | 12/2009 | Keel | B65D 5/4204 206/509 |
| 7,823,725 | B1 | 11/2010 | Shupe | |
| 8,413,836 | B2 * | 4/2013 | Senn | B65D 81/054 220/588 |
| 8,833,573 | B2 * | 9/2014 | Tomaszewski | B65D 19/385 206/509 |
| 9,428,298 | B2 | 8/2016 | Bersamin et al. | |
| 9,731,860 | B2 * | 8/2017 | Kretz | B65D 5/48048 |
| 9,783,333 | B1 | 10/2017 | De Los Santos et al. | |
| 2016/0144998 | A1 | 5/2016 | Kretz et al. | |

* cited by examiner

PALLET-SIZED SHIPPING AND DISPLAY TRAY

CROSS REFERENCE TO RELATED APPLICATIONS

This application claims priority to U.S. provisional patent application Ser. No. 62/136,006, filed 20 Mar. 2015, and as a divisional of U.S. non-provisional application No. Ser. No. 15/069,007, filed 14 Mar. 2016, both of which are hereby incorporated hereinto by reference as if fully restated herein.

FIELD OF THE INVENTION

This invention relates generally to product displays, and more particularly to a pallet-sized shipping and display tray supporting stacked products at a point of sale.

BACKGROUND OF THE INVENTION

Products shipped to retail club stores such as Costco, BJ's and Sam's Club, for example, are commonly displayed for sale to the public in the bulk container or tray in which the products were shipped. For most products, placing the container on the floor is not satisfactory because the consumer would have to bend over to closely view and/or access the product. It is preferable, therefore, to support the tray/container in an elevated position to bring the product to eye level and make it more easily accessible to the consumer. Since product shipped in bulk containers/trays typically is palletized, extra pallets become available at the retail establishment as product is sold and trays/containers are emptied. It is a common practice for the retailer to stack several of these pallets on top of one another and to support the tray/container on top of the stack of pallets in order to elevate the container to a suitable position. Almost all of the full pallet displays are made for club stores. These large display trays are generally designed to promote new products. The products are filled in these trays situated over stacked pallets. Most full and partial pallet displays are located at the ends ("endcaps") of shopping aisles, where customers can shop from two sides—this is their greatest advantage. Another advantage of these display trays comes from the multi-level trays stored on top of the pallet display. However, there are challenges that need to be overcome when heavy products are stacked.

Therefore, it is desirable to have a pallet-sized shipping and display tray that improves the strength and display function of the club store circuit pallet-sized display tray.

SUMMARY OF THE INVENTION

The claimed invention is directed to a 40×48 inch pallet-sized shipping and display tray that improves the strength and display function of the club store circuit pallet-sized display tray when 2 lb bagged products are disposed in a 40×48 inch pallet-sized display tray that contains 80 lbs of this product in it. Some of the advantages of the claimed invention are, for example, 1) supporting 80 lbs of product several layers high per pallet and then stacking them 3 or 4 pallets high in a warehouse require adequate vertical strength for storage, 2) keeping the number of display trays to as few as possible while designing and constructing a fast and easy assembly and un-assembly of the pallet-sized display tray which impacts cost, and product manufacturing labor or retailer labor, and 3) the pallet-sized shipping and display tray should be designed and constructed so that the product shop-able area to be all four sides with uninterrupted product access from front to the back of the display tray which reduces retailer labor. In doing so, removing center beam panel and opening the center area of the display tray may causes sagging issues. The center area of the display tray needs support but it can't block access of product to customers. In addition, the pallet-sized display tray should be strong enough to handle shaking and rocking during shipping and transportation. It is also advantageous for the pallet-sized display tray to have corner support for stretch wrap and to protect the tray's corners from damages.

Accordingly, one aspect of the present invention is directed to a pallet-sized shipping and display tray having a base portion and two spaced-apart vertical columns configured to be supported by the base portion. At least one deck is configured to be attached to the two spaced-apart vertical columns to form a bridge so as to adequately support a weight of one or more upper display trays when they are stacked upon one another. The base portion includes a bottom wall having four upstanding base side walls foldably joined to one another to form a shallow interior space. The two spaced-apart vertical columns are disposed in the shallow interior space. The base portion further includes a plurality of slots formed on the bottom wall. The two spaced-apart vertical columns are defined by respective first and second spaced-apart vertical columns in which each of the respective first and second spaced-apart vertical columns includes two shoulder panels, two coterminous spine panels, and two arm panels all of which are foldably joined to one another. Each of the respective shoulder panels includes a respective foot flap which is foldably joined thereto and each extends outwardly from respective bottom of the shoulder panels. Each of the respective shoulder panels includes a generally U-shaped first notch each of which extends from respective free edges toward the center of each shoulder panel. Each of the two coterminous spine panels includes first foot flanges each of which foldably extends from respective lateral edges. Each of the two respective coterminous spine panels includes a generally U-shaped second notch each of which extends from respective free edges toward the center of the respective spine panels. The two spine panels are coextensively folded and are attached to one another via a first locking tab and a first slot. Each of the two arm panels includes second foot flanges each of which folds inwardly toward the respective spine panels. The at least one deck includes a supporting panel having two side depending flanges and two end depending flanges all of which are foldably joined to one another. The respective side depending flanges includes a respective pair of spaced apart third notches each of which is engaged with corresponding notches of the two spaced-apart vertical columns. Each of the respective end depending flanges includes a respective fourth notch each of which is engaged with the corresponding notches of the spine panels. The at least one deck includes two decks configured to be contiguously attached to the two spaced-apart vertical columns to form the bridge so as to adequately support the weight of one or more upper display trays when being stacked upon one another.

Another aspect of the present invention is directed to a pallet-sized shipping and display tray comprises a base portion having an interior space and opposed sides ends. The respective spaced-apart first and second vertical columns each of which is configured to be positioned in the opposed ends of the interior space of the base portion. Each of the respective first and second spaced-apart vertical columns includes two shoulder panels, two coterminous spine panels, and two arm panels all of which are foldably joined to one another. At least one deck is configured to be attached to the respective spaced-apart first and second vertical columns to form a bridge. The at least one deck includes a supporting panel having two side depending flanges and two end depending flanges all of which are foldably joined to one another so as to adequately support a weight of one or more upper display trays when being stacked upon one another.

A further aspect of the present invention is directed to plurality of blanks attached to one another for making a pallet-sized shipping and display tray. The plurality of blanks comprises a first blank divided by a plurality of orthogonal fold lines to form a bottom wall panel having sidewalls panels foldably extend from the fold lines. The bottom wall of the first blank includes four angled slot each of which is formed on respective corners of the bottom wall. Each of the side wall panels is defined by respective inner panel and outer panel foldably joined to one another. Four spaced apart locking tabs are formed on free edge of the outer panel and respective four corresponding spaced apart slots are formed on the bottom wall. The respective outer panels include two tuck flaps each of which extends from respective lateral edges thereof. The inner panels include two tuck flaps each of which extends from respective lateral edges thereof. A second blank is configured to be foldably joined to the first blank. The second blank is divided into two shoulder panels, two spine panels, and two arm panels all of which are foldably joined to one another via fold lines. The two spine panels are joined to one another by two parallel score lines. A third blank is configured to be foldably joined to the second blank. The third blank is divided into a supporting panel and four depending flanges by four orthogonal fold lines. The four depending flanges are defined by two side depending flanges and two end depending flanges foldably extend from the supporting panel. Each of the respective side depending flanges includes two spaced apart third notches and each of the respective end depending flanges includes a respective fourth notch which is formed from free edge toward the center thereof. The first, second, and third blanks are foldably engaged with one another for constructing the pallet-sized shipping and display tray.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
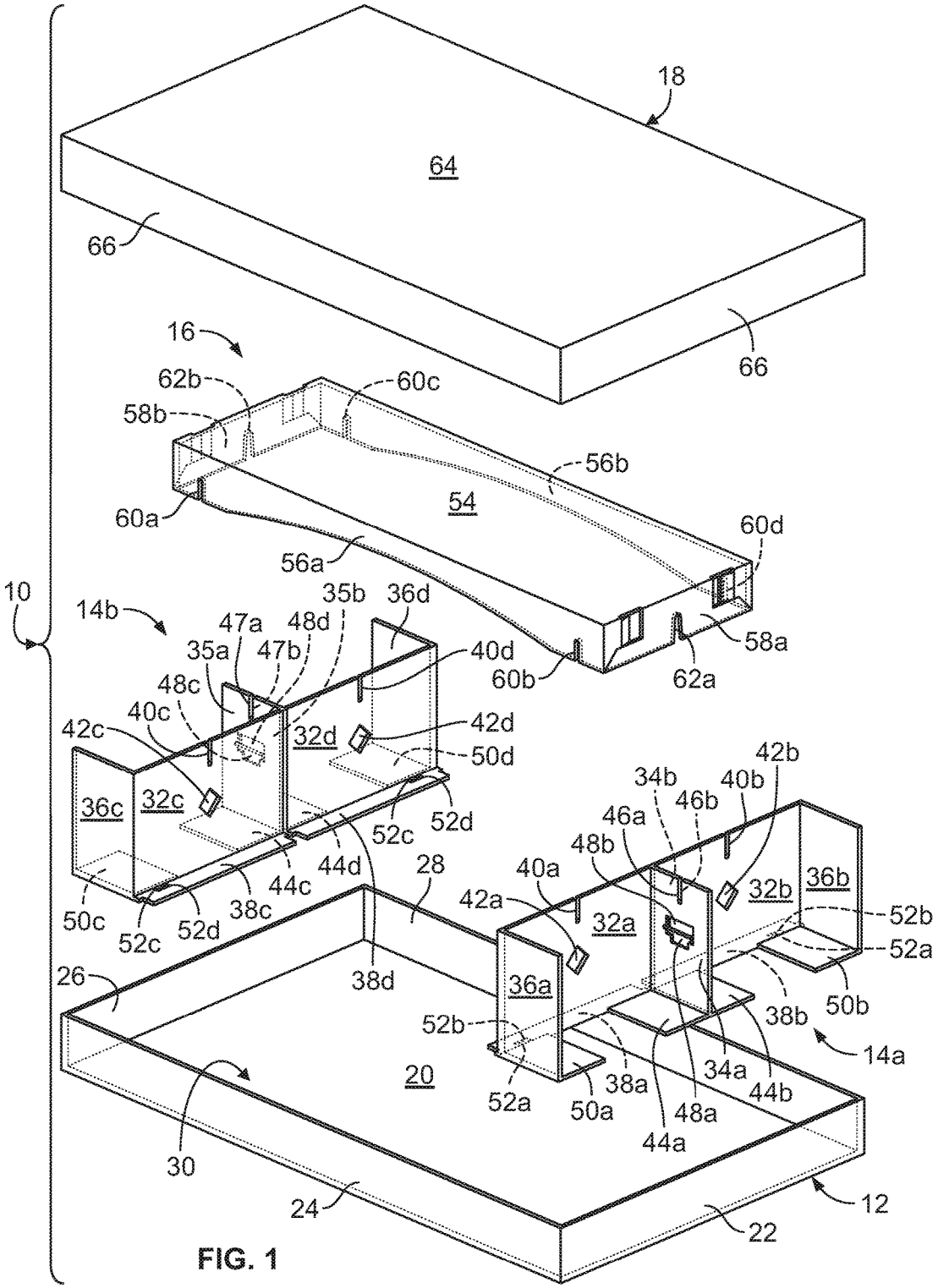
FIG. 1 is an exploded top perspective view of a pallet-sized display tray having a base portion, two E-shaped vertical columns, a deck, and a shipping cap wherein all of them are in a spaced relationship with one another in accordance to the first embodiment of the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same.

FIG. 1 is an exploded perspective view of a pallet-sized display tray 10 and comprises a base portion 12, respective first and second E-shaped vertical columns 14*a*, 14*b*, a deck 16, and a shipping cap 18 in which all of them are in a spaced-apart relationship with one another in accordance to a first embodiment of the invention. The two respective E-shaped vertical columns 14*a*, 14*b* are spaced-apart from one another and are positioned inside of and on opposed sides or ends of the base portion 12 with respect to one another. Each respective end of the deck 16 is attached to the respective first and second E-shaped vertical columns 14*a*, 14*b* such that a bridge is formed to adequately support the weight of upper display trays 10 stacked on one another. An optional shipping cap 18 is used to cover the generally stacked pallet-sized display trays 10. The base portion 12 includes a bottom wall 20 having four upstanding base side walls 22, 24, 26, and 28 foldably joined to one another to form a shallow interior space 30. The respective first and second E-shaped vertical columns 14*a*, 14*b* are structurally the same and they are mirror image of one another.

The first E-shaped vertical column 14*a* includes two shoulder panels 32*a*, 32*b*, two coterminous spine panels 34*a*, 34*b*, and two arm panels 36*a*, 36*b* all of which are foldably joined to one another. Each of the respective shoulder panels 32*a* and 32*b* includes a respective foot flap 38*a* and 38*b* which are foldably joined thereto and each extends outwardly from respective bottom of the shoulder panels 32*a*, 32*b*. In addition, each of the respective shoulder panels 32*a*, 32*b* includes a generally U-shaped first notch 40*a* and 40*b* each of which extends from respective free edges toward the center of each shoulder panel 32*a*, 32*b*. Finally, each of the respective shoulder panels 32*a* and 32*b* includes a respective diamond-shaped or octagonal or the likes cut out 42*a*, 42*b* formed in the respective central portions thereof to facilitate viewing of the products by the customers. Each of the two coterminous spine panels 34*a*, 34*b* includes first foot flanges 44*a*, 44*b* each of which foldably extends from respective lateral edges. Moreover, each of the two respective coterminous spine panels 34*a*, 34*b* includes a generally U-shaped second notch 46*a* and 46*b* each of which extends from respective free edges toward the center of the respective spine panels 34*a*, 34*b*. The two spine panels 34*a*, 34*b* are coextensively folded and attached to one another via a first locking tab 48*a* and a first slot 48*b*. Each of the two arm panels 36*a*, 36*b* includes second foot flanges 50*a* and 50*b* each of which is folded inwardly toward the respective spine panels 34*a*, 34*b*.

The second E-shaped vertical column 14*b* includes two shoulder panels 32*c*, 32*d*, two coterminous spine panels 35*a*, 35*b*, and two arm panels 36*c*, 36*d* all of which are foldably joined to one another. Each of the respective shoulder panels 32*c* and 32*d* includes a respective foot flap 38*c* and 38*d* which are foldably joined thereto and each extends outwardly from respective bottom of the shoulder panels 32*c*, 32*d*. In addition, each of the respective shoulder panels 3*ca*, 32*d* includes a generally U-shaped first notch 40*c* and 40*d* each of which extend from respective free edges toward the center of each shoulder panel. Finally, each of the respective shoulder panels 32*c* and 32*d* includes a respective cutout 42*c*, 42*d* formed in the respective central portions thereof to facilitate viewing of the products by the customers. The cut out 42*c*, 42*d* can be any shape such as diamond, octagonal or the likes and it is not limited. Each of the two coterminous spine panels 35*a*, 35*b* includes first foot flanges 44*c*, 44*d* each of which foldably extend from respective lateral edges. Moreover, each of the two respective coterminous spine panels 35*a*, 35*b* includes a generally U-shaped second notch 47*a* and 47*b* each of which extend from respective free edges toward the center of the respective spine panels 35*a*, 35*b*. The two spine panels 35*a*, 35*b* are coextensively folded and attached to one another via a first tab 48*c* and a first slot 48*d*. The coterminous spine panels 35*a*, 35*b* are foldably joined to the shoulder panels and significantly enhance the overall vertical strength of the shipping and display tray. Each of the two arm panels 36*c*, 36*d* includes second foot flanges 50*c* and 50*d* each of which is folded inwardly toward the respective spine panels 35*a*, 35*b*.

The deck 16 includes supporting panel 54 having two deck side depending flanges 56*a*, 56*b* and two deck end depending flanges 58*a*, 58*b* foldably joined to one another. Each of the side depending flanges 56*a*, 56*b* includes a respective pair of spaced apart third notches 60*a*, 60*b* and 60*c*, 60*d* each of which is engaged with corresponding notches 40*a*, 40*b*, 40*c*, and 40*d* of the respective first and second E-shaped vertical columns 14*a*, 14*b*. Similarly, each of the respective end depending flanges 58*a*, 58*b* includes a respective fourth notch 62*a*, 62*b* each of which is engaged with the corresponding notches 46 and 47 of the spine panels 34 and 35. It should be noted that more one deck 16 can be used depending on the size of the first and second E-shaped vertical columns 14*a*, 14*b*. The shipping cap 18 includes a top panel 64 having four depending flanges 66 each of which extends downwardly therefrom and foldaby joined to one another.

Figure 2:
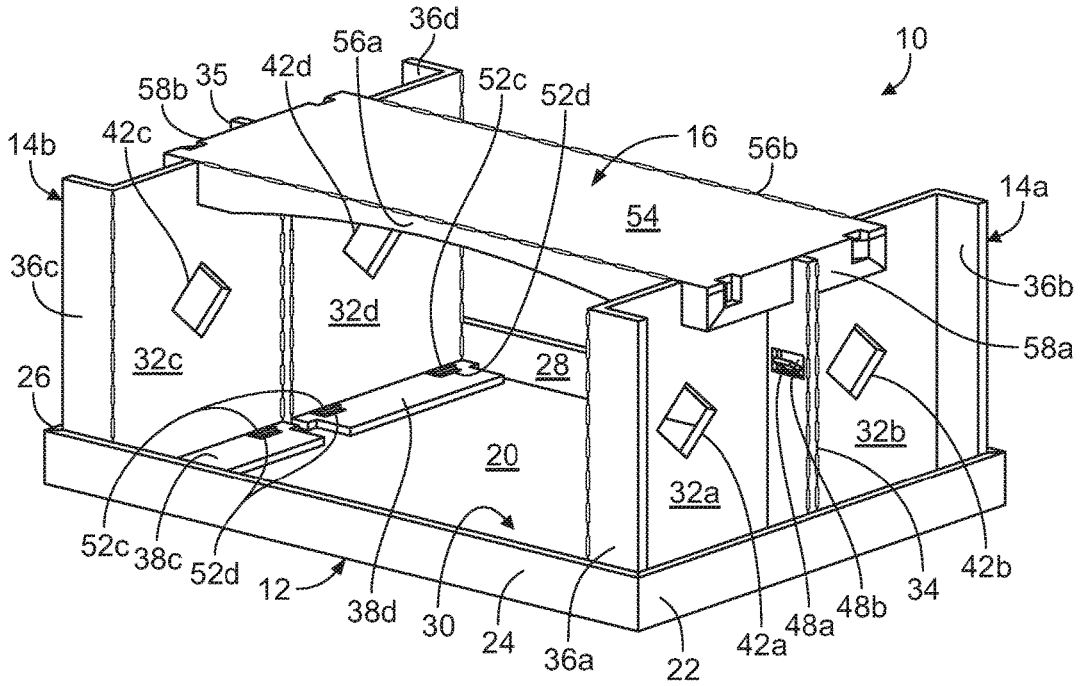
FIG. 2 is a top perspective view of the pallet-sized shipping and display tray illustrated in FIG. 1 in an assembled position with the shipping cap removed.
Figure 3:
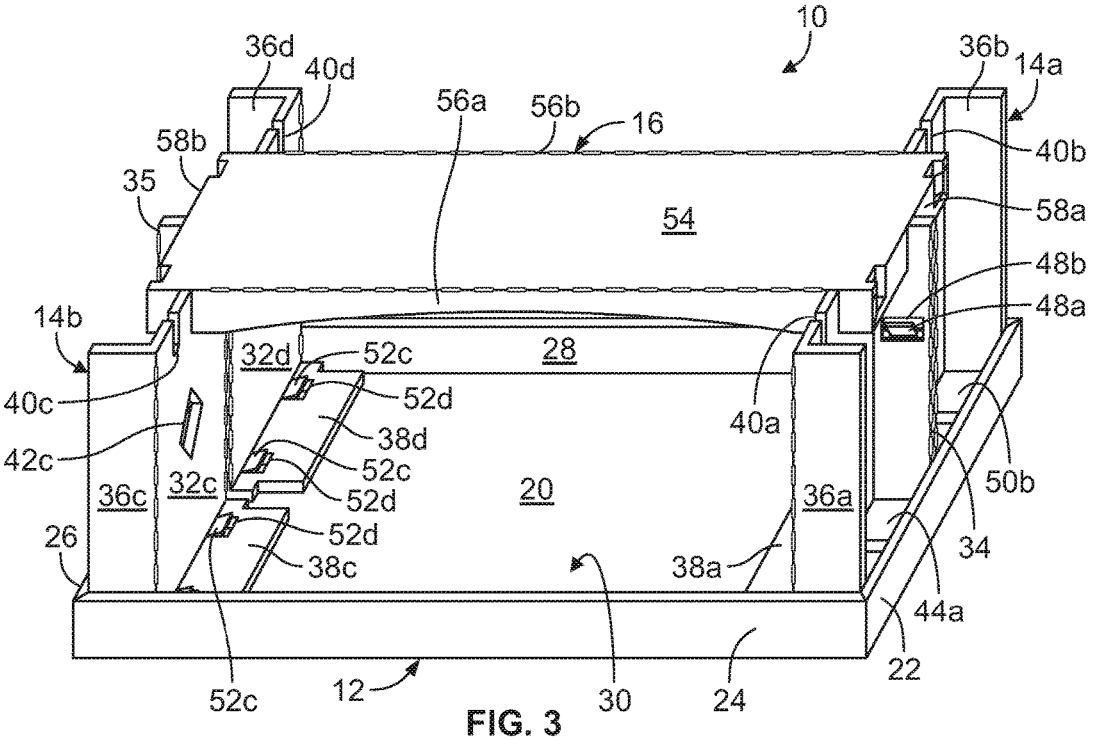
FIG. 3 is a front perspective view of the pallet-sized display tray illustrated in FIG. 2.
Figure 4:
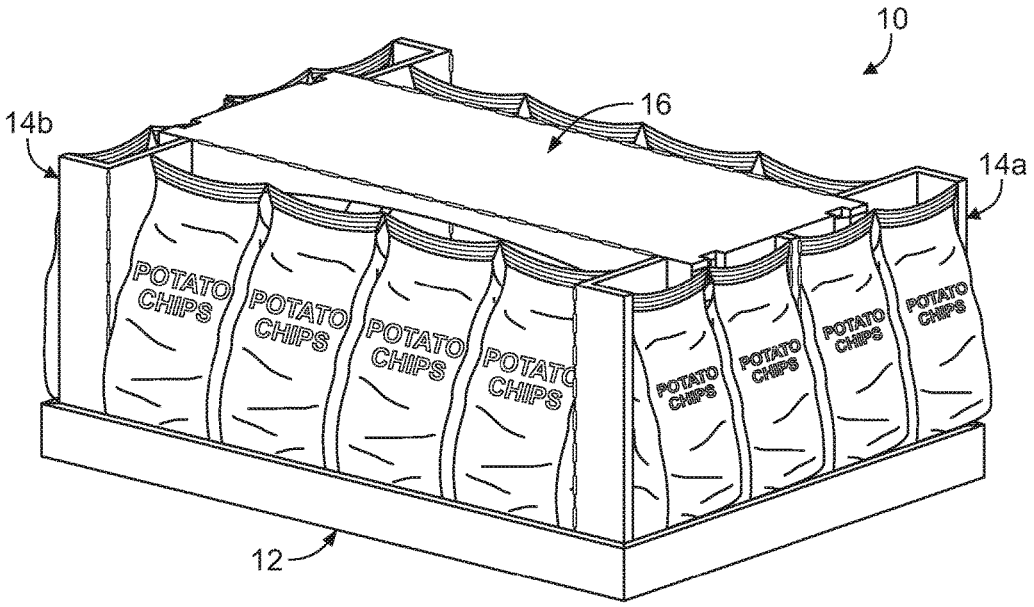
FIG. 4 is a side perspective view of the pallet-sized shipping and display tray filled with products.

To assemble the pallet-sized display tray 10, the respective first and second E-shaped vertical columns 14*a*, 14*b* are disposed inside of and on opposed side of the base portion 12 with respect to one another. Next, as shown in FIGS. 2 and 3, each respective end and side notches of the deck 16 is locked into to the respective first and second E-shaped vertical columns 14*a*, 14*b* via respective notches 40*a*, 40*b*, 40*c*, 40*d*, 46 and 47 such that a bridge is formed to adequately support the weight of upper pallet-sized display trays 10 stacked on one another. Then the display tray 10 is filled with the products as illustrated in FIG. 4. As illustrated in FIGS. 2-4, the pallet-sized display tray 10 is designed and constructed so that the product shop-able area to be all four sides with uninterrupted product access from front to the back of the tray which reduces retailer labor. The shipping and display tray 10 normally is shipped on a 48×40 inch pallet in which three or four of the shipping and display tray 10 stacked on one another. For shipping, three or four of the display tray 10 are placed on a single pallet and shipped to a point of sale. At so-called big box stores, or club stores, the product typically is left in the tray for display and sale. To facilitate viewing of the product and access to it, the retailer may place a stack of six pallets on the floor and then support the trays and its shipping pallet on top of this stack. The stack of pallets, including that on which the display trays 10 are shipped, typically has a height of about 35 inches. This brings the display trays 10 to approximately eye level.

Figure 5:
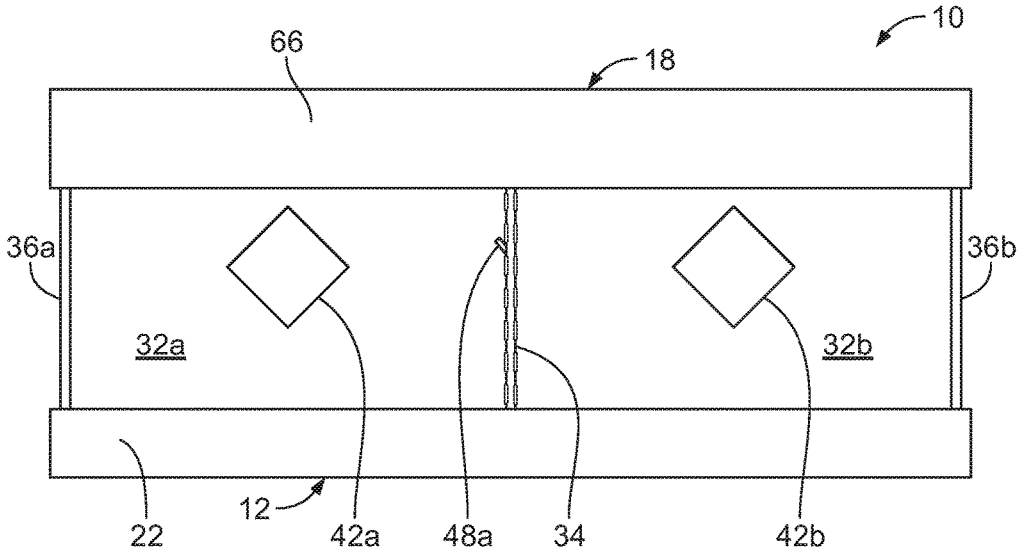
FIG. 5 is a front view of the pallet-sized shipping and display tray illustrated in FIG. 2 having the shipping cap covering the top of the tray.

FIG. 5 is a front perspective view of the pallet-sized display tray 10 illustrated in FIG. 2 having the shipping cap 18 covering the top of the tray 10. The claimed invention tray 10 has a dimension of 40×48 inches which correspond to a standard size of a typical industrial pallet. For example, 2 lb bagged products are disposed in the 40×48 pallet-sized display tray 10 that contains 80 lbs of this product in it. Supporting 80 lbs of product several layers high per pallet and then stacking them 3 or 4 pallets high in a warehouse require adequate vertical strength for storage. It should be noted that the shipping cap 18 is optional and it is generally used during shipment and transportation of the pallet-sized display tray 10.

Figure 6:
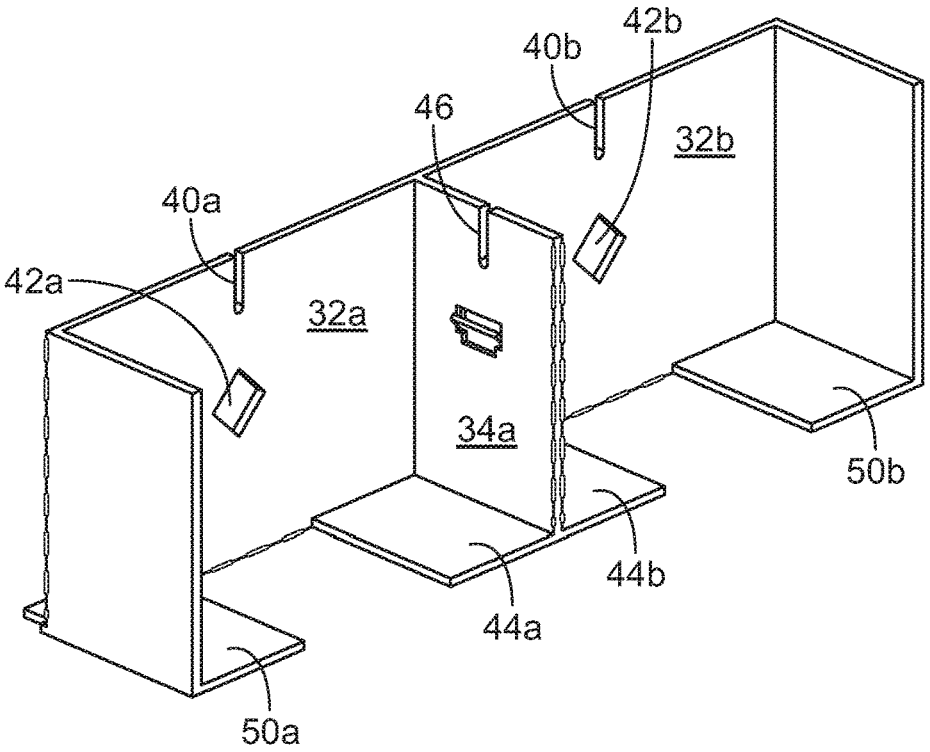
FIGS. 6 and 7 depict the respective front and back of the E-shaped vertical columns.
Figure 7:
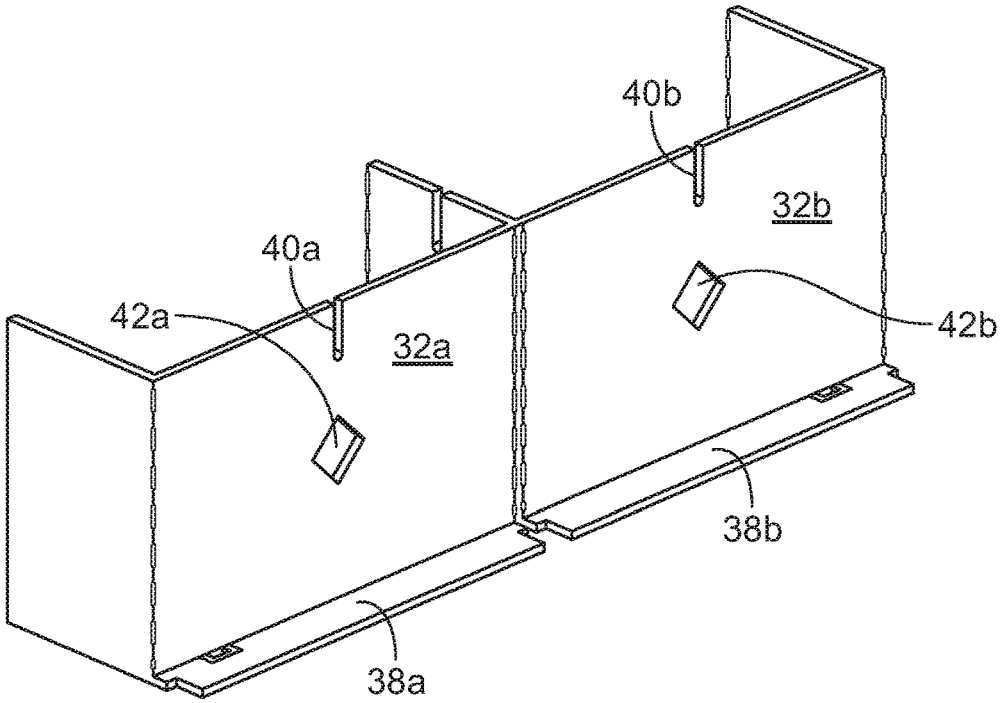

FIGS. 6 and 7 depict the respective front and back of the E-shaped vertical columns. The E-shaped vertical columns are provides additional strength with the spine panels and resist the sliding around when first and second foot flanges are connected and formed away from the E-shaped side. This configuration provides stability and resistance to the vertical support tipping near the bottom edges. The E-shaped vertical columns may use locking features or glue to hold the E-shaped columns to the base portion. The E-shaped vertical columns create a firm panel in the corner of the tray which protects shrink wrap damage of the tray. This area near the corner is also being tested to eliminate the corner board components typically used. Moreover, E-shaped vertical columns have diamond-shaped or any other shape cutouts to view the products. Alternatively, the E-shaped vertical columns are also being tested with stacking tabs to connect layers to layers of the trays.

Figure 8:
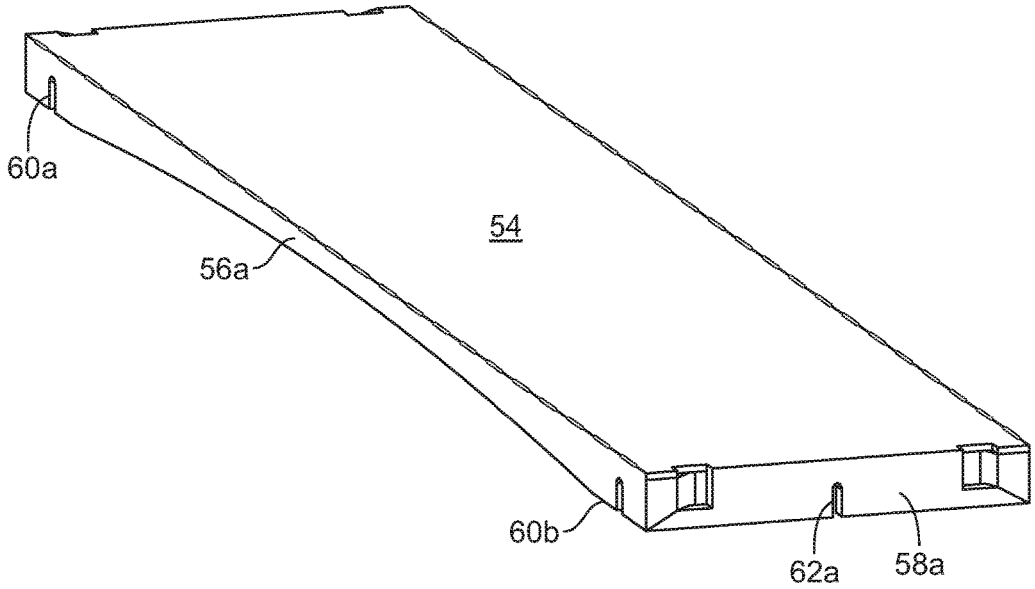
FIGS. 8 and 9 depict the respective top surface and underneath of the deck.
Figure 9:
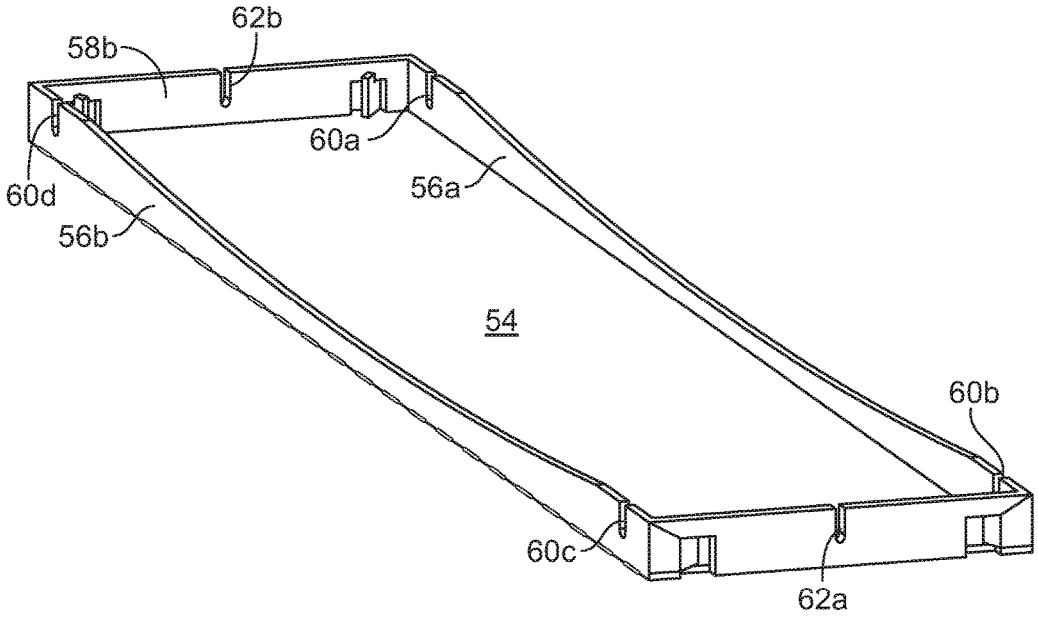

FIGS. 8 and 9 depict the respective top surface and underneath of the deck 16. The deck 16 supports the weight of another pallet-sized display tray 10 stacked upon it and prevents tray sag. The deck 16 connects the E-shaped vertical columns 14*a*, 14*b* together holding the top edges together. The deck 16 is easily self locking or glued and has a folded panel along the long main panel to provide rigidity once assembled with the E-shaped vertical columns 14*a*, 14*b*. These folded panels are very important in eliminating tray sag. The deck 16 may also be used to eliminate the shipping cap 18 of the pallet-sized display tray 10 that typically used.

Figure 10:
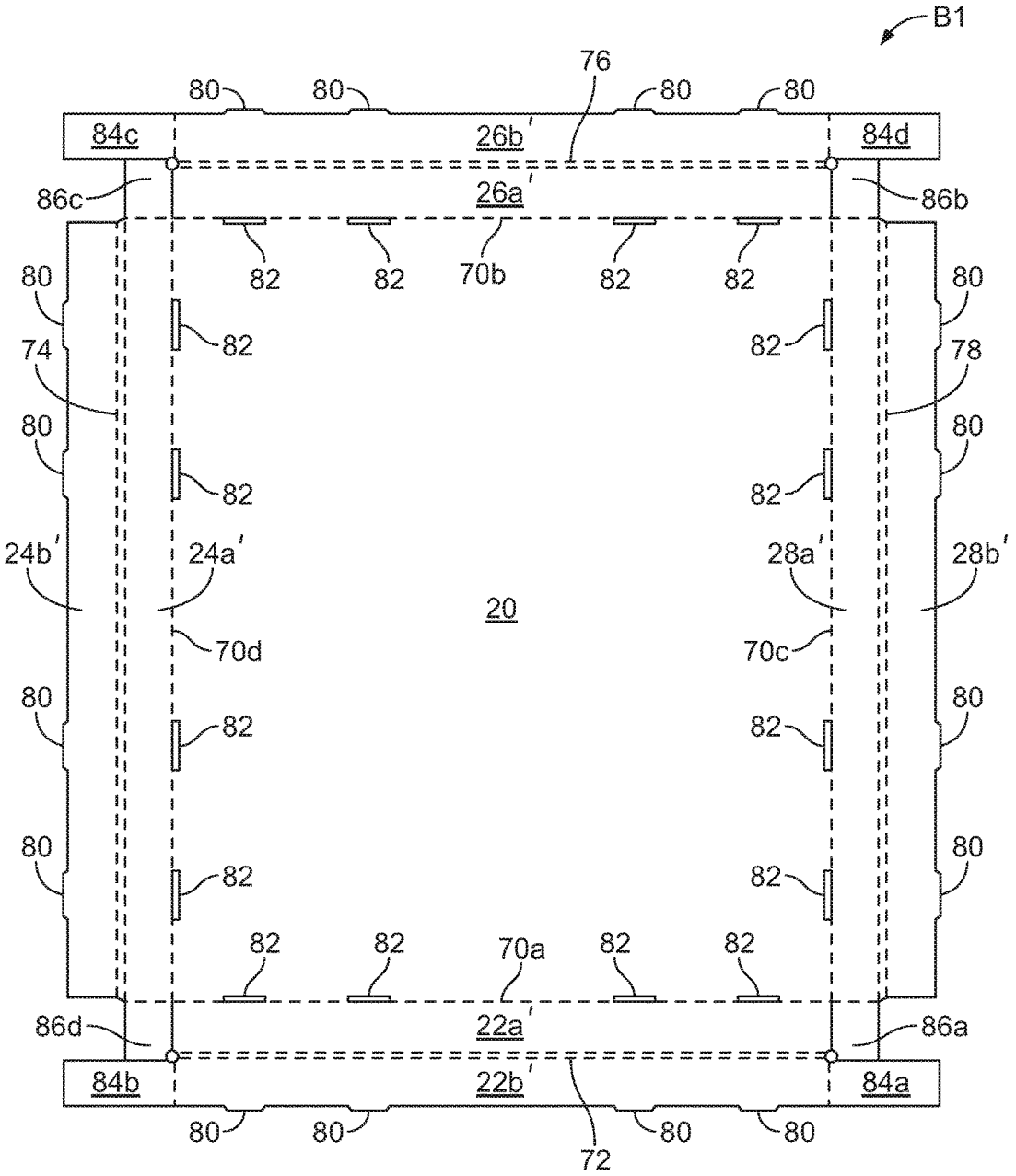
FIG. 10 is a top plan view of a blank B1 for making the base portion shown in FIG. 1.

FIG. 10 is a top plan view of a first blank B1 for making the base portion shown in FIG. 1. The first blank is preferably an integral piece of a material such as continuous sheet of conventional corrugated paperboard. The blank B1 is cut along its outer margins to form its specific shape so that corresponds to the shape of the base portion 12. The base portion 12 includes a bottom wall 20' having eight base side wall panels, namely, inner panel 22*a*', outer panel 22*b*'; inner panel 24*a*', outer panel 24*b*'; inner panel 26*a*', outer panel 26*b*'; and inner panel 28*a*', outer panel 28*b*' foldably joined to one another. The side wall panels 22*a*' are 22*b*' are defined two score line or fold lines 72, the side wall panels 24*a*' are 24*b*' are defined two score line or fold lines 74, the side wall panels 26*a*' are 26*b*' are defined two score line or fold lines 76, and the side wall panels 28*a*' are 28*b*' are defined two score line or fold lines 78. In the folded position, the respective base side wall panels 22*a*', 22*b*' form the side wall 22; the respective base side wall panels 24*a*', 24*b*' form the side wall 24; the respective base side wall panels 26*a*', 26*b*' form the side wall 26; and the respective base side wall panels 28*a*', 28*b*' form the side wall 28. There are respective four spaced apart locking tabs 80 formed on free edges of the respective outer panels 22*b*', 24*b*', 26*b*', and 28*b*' and respective four corresponding spaced apart slots 82 formed on the bottom wall. Moreover, the respective outer panel 22*b*' and outer panel 26*b*' include respective two tuck flaps 84*a*, 84*b*; 84*c*, 84*d* each of which extends from respective lateral edges thereof. Similarly, respective inner panels 24*a*' and 28*a*' includes respective two tuck flaps 86*a*, 86*b*; 86*c*, 86*d* each of which extends from respective lateral edges thereof. To form the interior space 30 shown in FIG. 1, the respective aforementioned side wall panels 22*a*', 22*b*'; 24*a*', 24*b*'; 26*a*', 26*b*'; and 28*a*', 28*b*' are folded onto itself with the respective tuck flaps sandwiched between the inner and outer panels and then attached to the bottom wall 20' via the respective locking tabs 80 and the slots 82.

Figure 11:
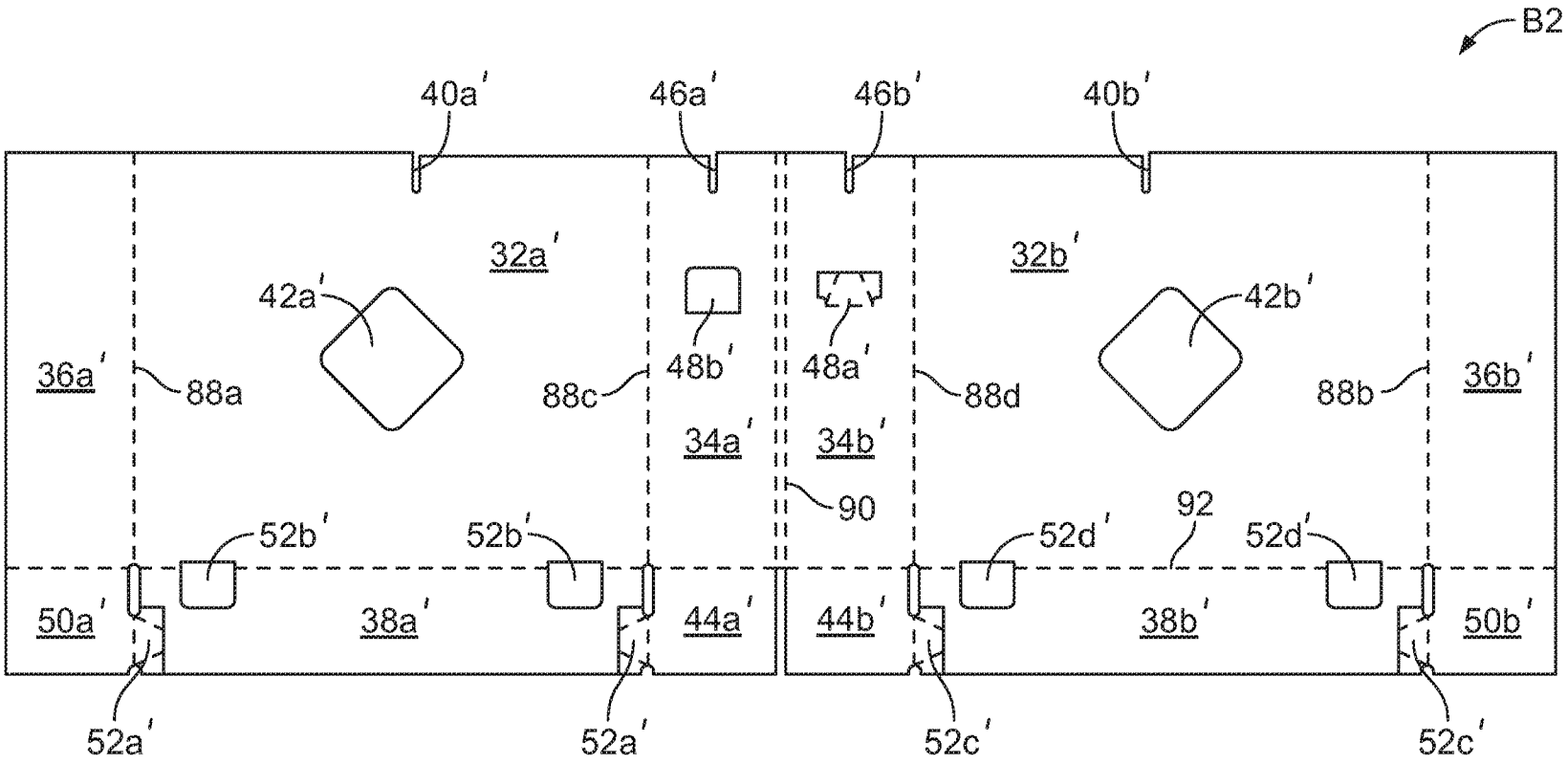
FIG. 11 is a top plan view of a blank B2 for making the respective E-shaped vertical columns shown in FIG. 1.

FIG. 11 is a top plan view of a second blank B2 for making the respective E-shaped vertical columns shown in FIG. 1. The second blank is preferably an integral piece of a material such as continuous sheet of conventional corrugated paperboard. The blank B2 is cut along its outer margins to form its specific shape so that corresponds to the both respective first and second E-shaped vertical columns 14*a*, 14*b* in FIG. 1. The blank B2 is used to make the respective first and second E-shaped vertical columns 14*a*, 14*b* since they are structurally the same and they are mirror image of one another. The blank B2 is divided into two shoulder panels 32*a*, 32*b*, two spine panels 34*a*, 34*b*, and two arm panels 36*a*, 36*b* all of which are foldably joined to one another via fold lines 88*a*, 88*b*, 88*c*, and 88*d*. The two spine panels 34*a*, 34*b* are joined to one another by two parallel score lines or fold lines 90. The foot flap 38*a* and 38*b*, the first foot flanges 44*a*, 44*b*, and the second foot flanges 50*a* and 50*b* are defined by fold line 92. Each of the respective shoulder panels 32*a* and 32*b* includes a respective diamond-shaped cut out 42*a*, 42*b* formed in the respective central portions thereof to facilitate viewing of the products by the customers. The locking tab 48*a*' is formed on spine panel 34*b*' and the corresponding slot 48*b*' is formed on the spine panel 34*a*'. The locking tab is inserted into the slot 48*b*' when the two spine panels 34*a*, 34*b* are coextensively folded and attached to one another. Each of the first and second foot flanges 44*a*', 44*b*', 50*a*', 50*b*' includes a respective four locking tab 52*a*', 52*a*', 52*c*' and 52*c*' each of which is inserted to the corresponding slots 52*b*', 52*b*' and 52*d*', 52*d*' when the blank B2 is fully constructed.

Figure 12:
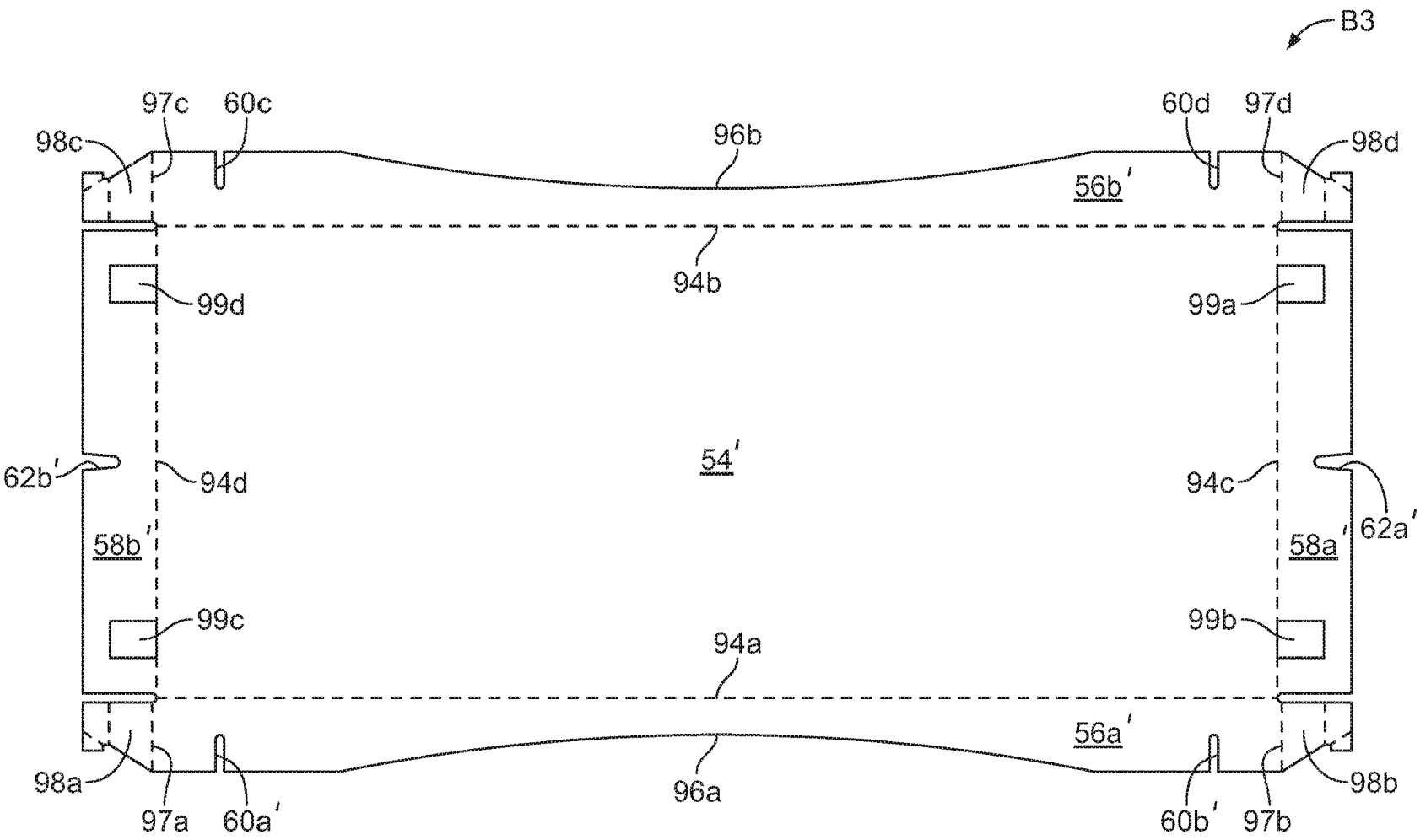
FIG. 12 is a top plan view of a blank B3 for making the deck shown in FIG. 1.

FIG. 12 is a top plan view of a third blank B3 for making the deck 16 shown in FIG. 1. The third blank is preferably an integral piece of a material such as continuous sheet of conventional corrugated paperboard. The blank B3 is cut along its outer margins to form its specific shape so that corresponds to the deck 16 shown in FIG. 1. The blank B3 includes a supporting panel 54' defined by four orthogonal fold lines 94*a*, 94*b*, 94*c*, and 94*d*. Each of the respective side depending flanges 56*a* and 56*b* foldably extends from respective fold lines 94*a*, 94*b*. Each of the respective end depending flanges 58*a*, 58*b* foldably extends from respective fold lines 94*c* and 94*d*. Each of the respective side depending flanges 56*a* and 56*b* includes two spaced apart third notches 60*a*', 60*b*' and 60*c*', 60*d*', respectively. It should be noted that the respective side depending flanges 56*a* and 56*b* includes a respective curvatures 96*a*, 96*b* each of which is formed on central portion of the respective flanges 56*a* and 56*b* to enhance the strength of the deck under heavy weights. Furthermore, each of the respective side depending flanges 56*a* and 56*b* includes a respective locking tab 98*a*, 98*b*, and 98*c*, 98*d* formed by the fold lines 97*a*, 97*b*, 97*c*, and 97*d*. Each of the respective end depending flanges 58*a*, 58*b* includes a respective fourth notch 62*a*', 62*b*' which is formed from free edge toward the center of the respective flanges 58*a*, 58*b*. Furthermore, each of the respective end depending flanges 58*a*, 58*b* includes a pair of spaced apart slots 99*a*, 99*b*; 99*c*, 99*d* that used to receive the respective locking tab 98*a*, 98*b*, 98*c*, 98*d* when the deck is fully constructed.

Figure 13:
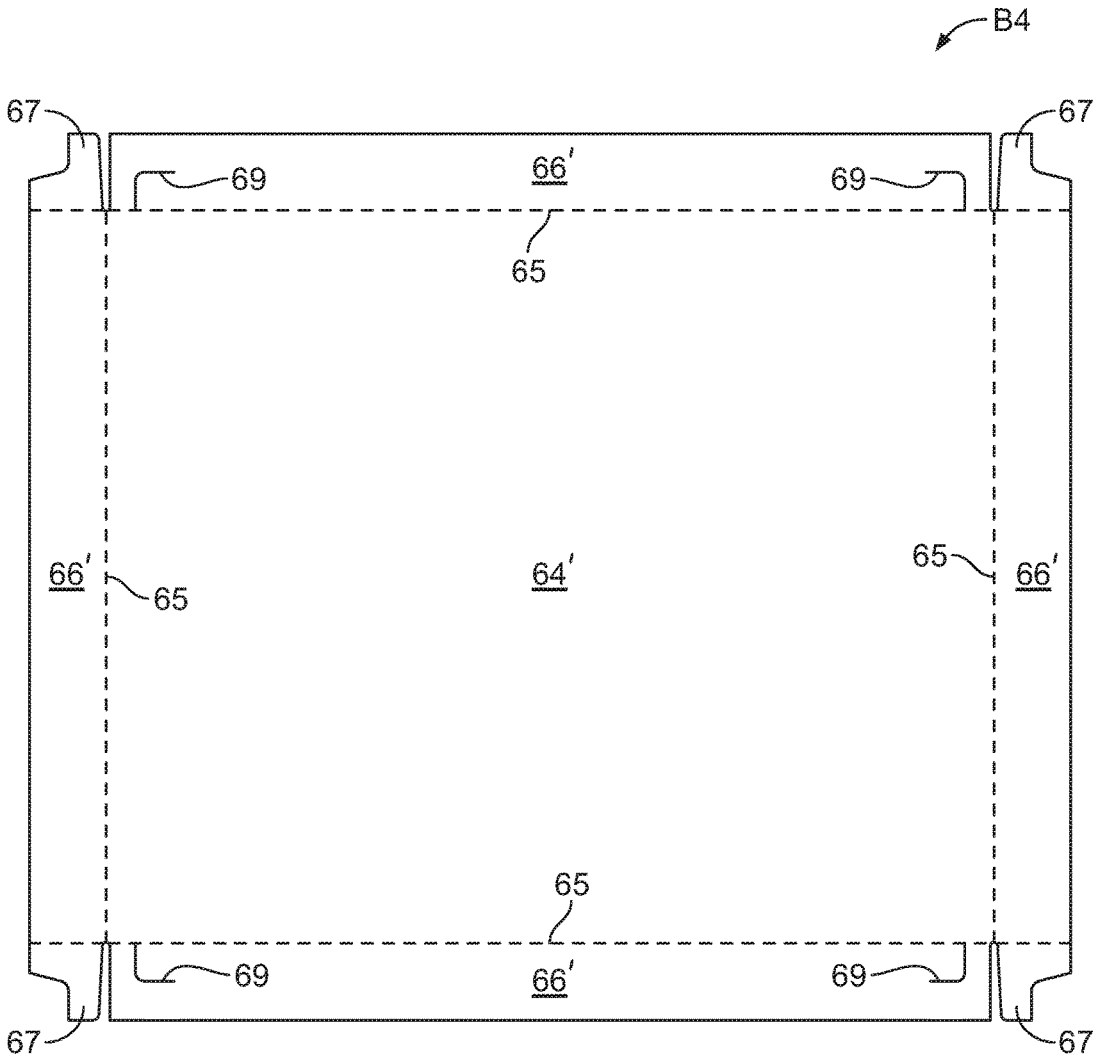
FIG. 13 is a top plan view of a blank B4 for making the shipping cap shown in FIG. 1.

FIG. 13 is a top plan view of a blank B4 for making the shipping cap shown in FIG. 1. The blank B4 includes a top panel 64' having four depending flanges 66' each of which extends foldaby extend thereof via fold lines 65. Two of the four the depending flanges 66' includes locking tabs 67 that are used to engage with the corresponding slots 69.

Figure 14A:
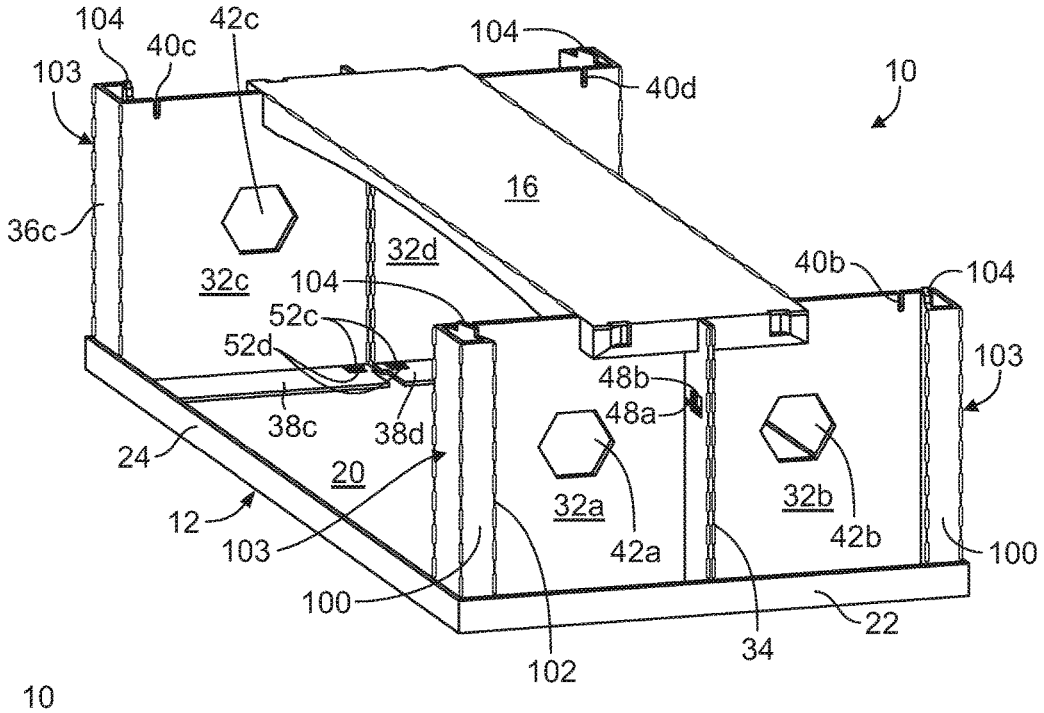
FIGS. 14A-14F depicts various perspective view of a pallet-sized display tray in accordance to a second embodiment of the invention.
Figure 14B:
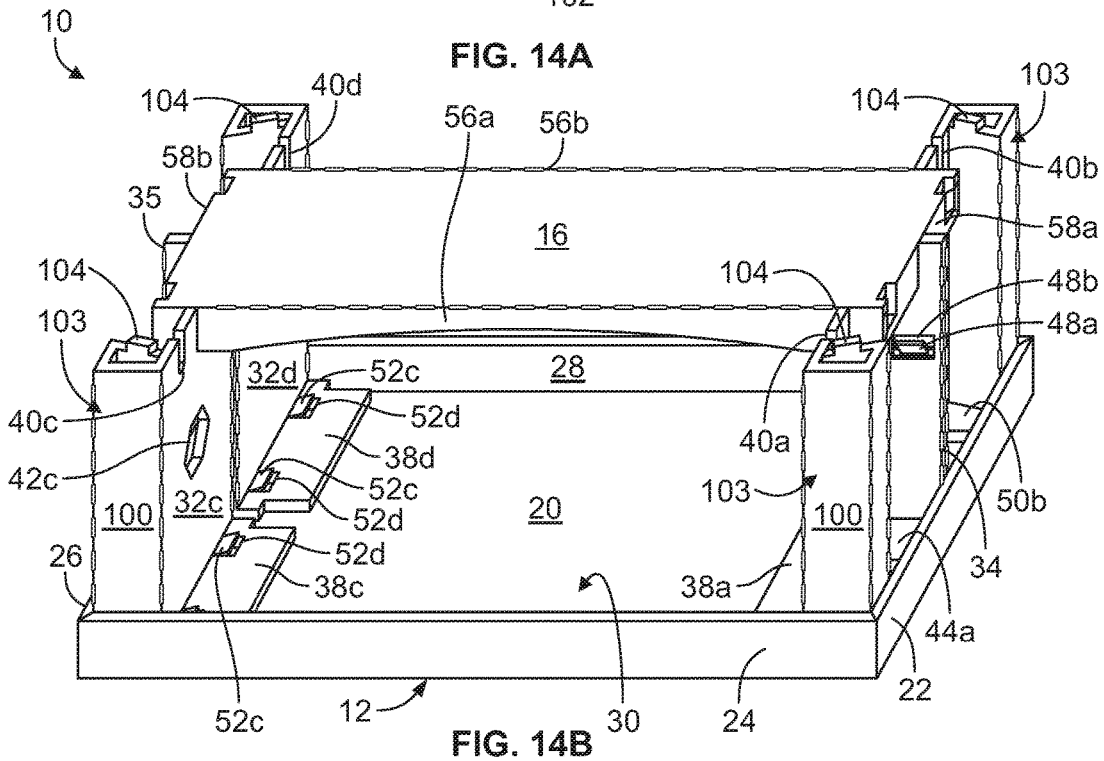
Figure 14C:
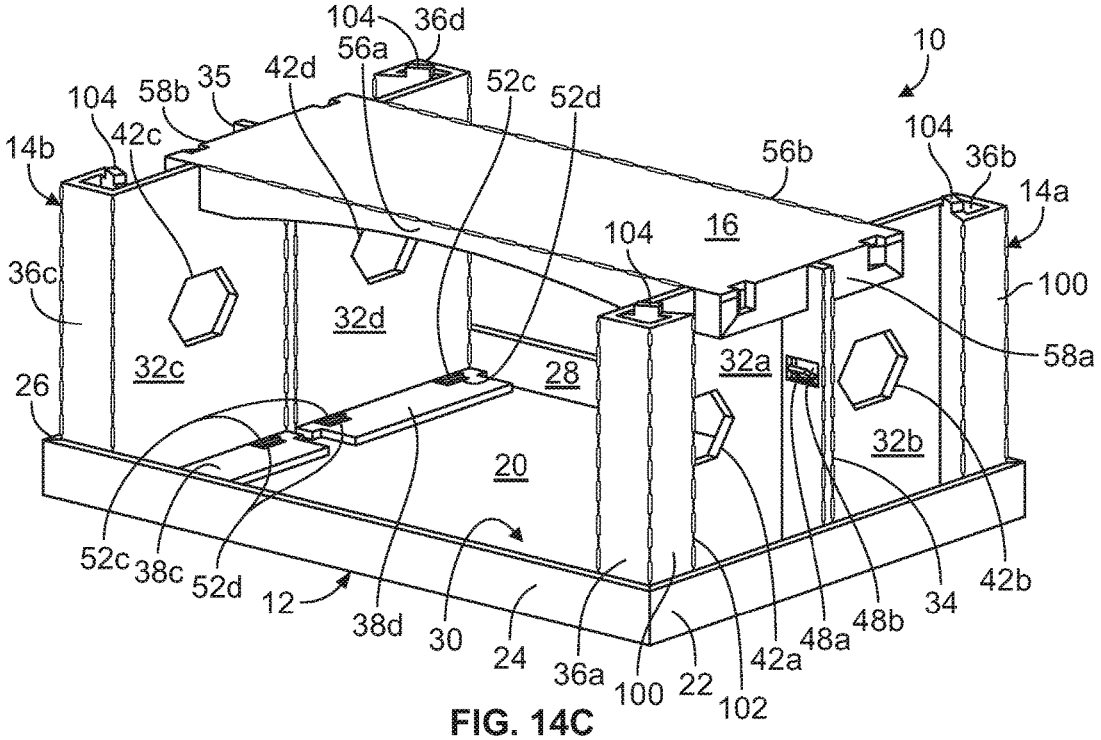
Figure 14D:
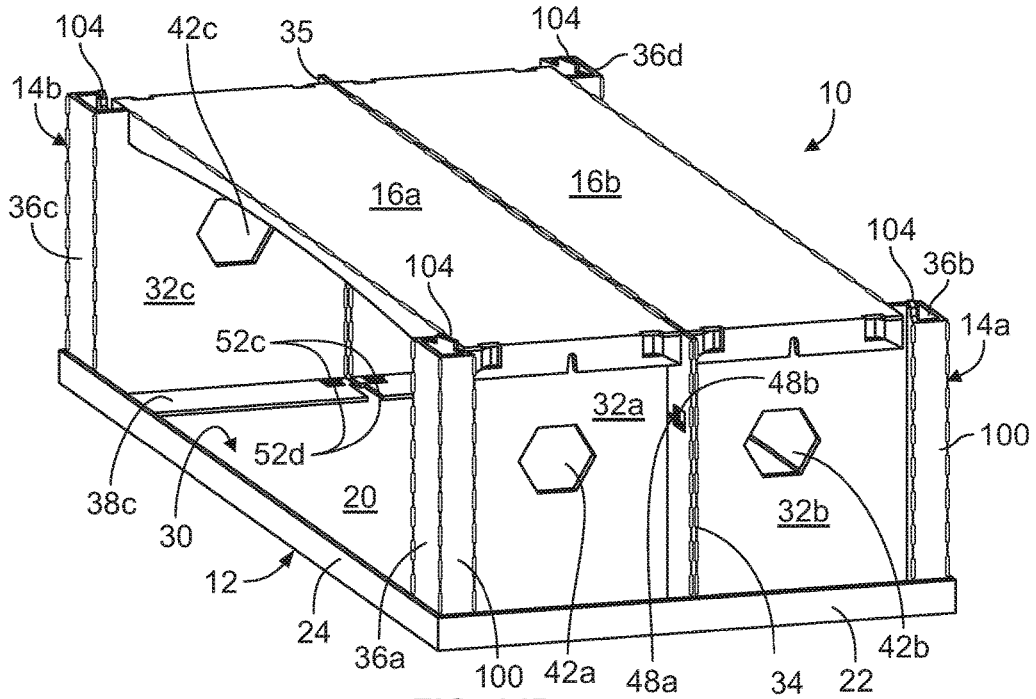
Figure 14E:
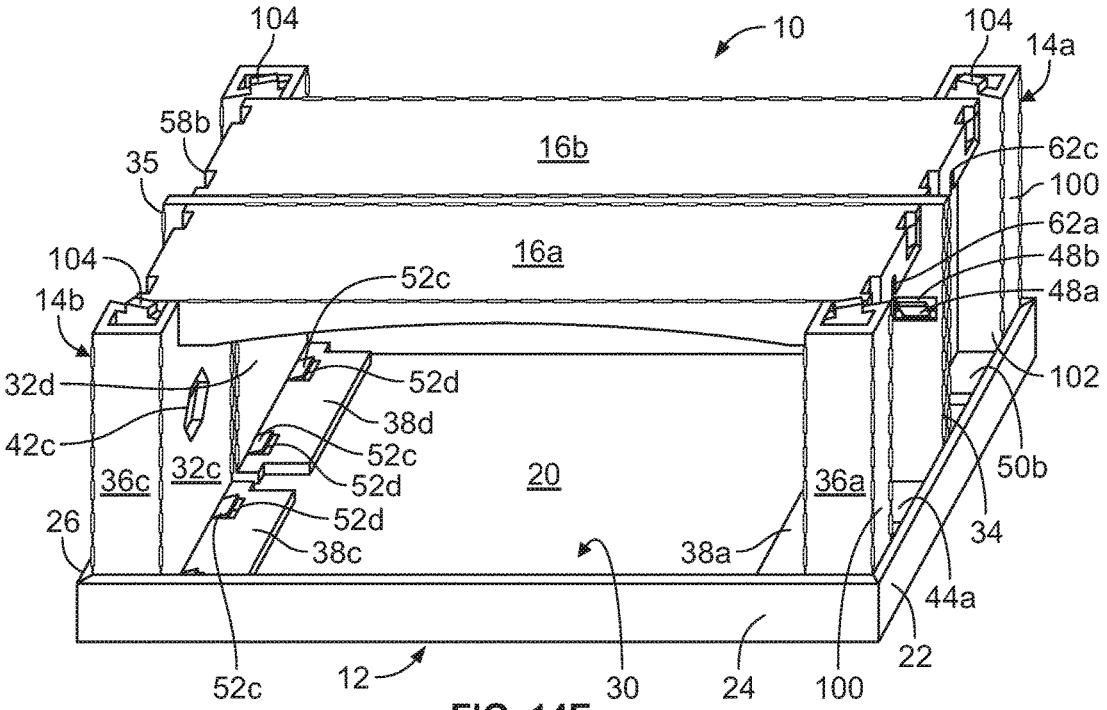
Figure 14F:
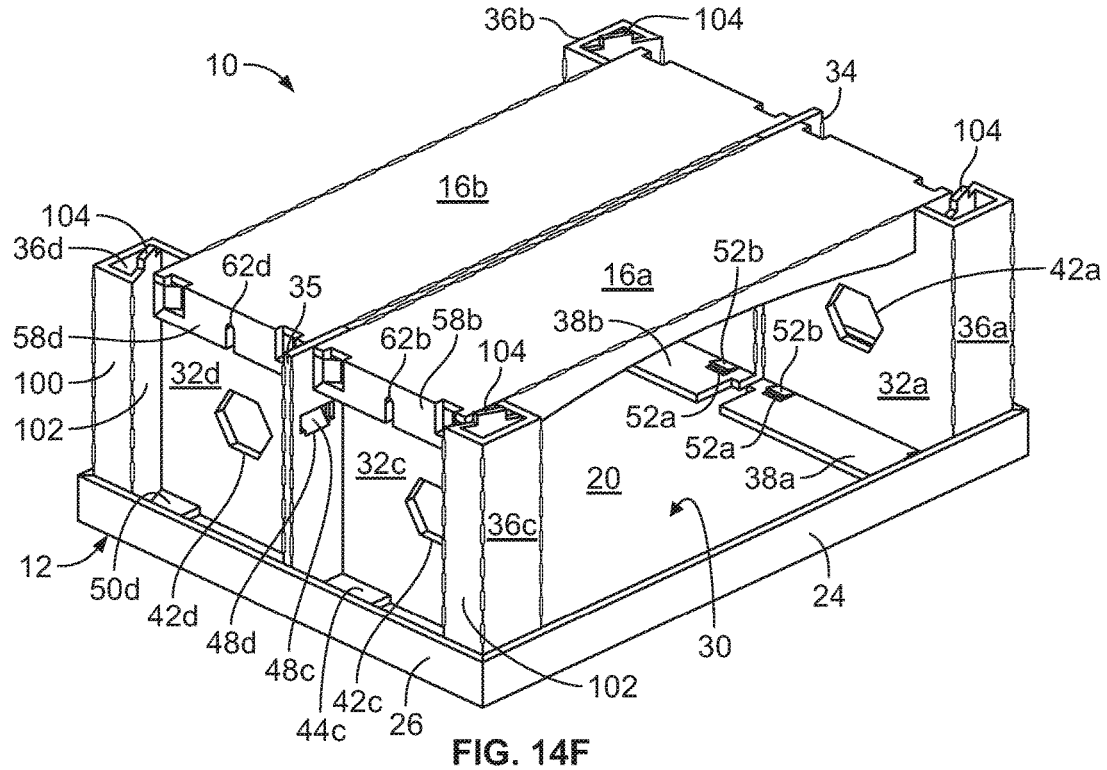

FIGS. 14A-14F depict various perspective view of a pallet-sized display tray in accordance to a second embodiment of the invention. For example, in FIGS. 14A-14C, each of the two arm panels 36*a*, 36*b* is fortified with two panels 100 and 102 foldably joined to the respective arm panels 36*a*, 36*b*. These panels 100 and 102 form a triangular gusset 103 in the corner of the pallet-sized display tray 10 which further enhance the strength of the display tray 10 at the corners and resemble a load bearing wall. The triangular gusset 103 also increases the rigidity to help withstand stretch wrap. Furthermore, the panel 102 also includes a stacking tab 104 that permits to lock the layers of the display trays to one another when they are stacked on one another. Moreover, FIGS. 14D-14F illustrates a pallet-sized display tray 10' with two decks 16*a*, 16*b* contiguously attached to the respective E-shaped vertical columns 14*a*, and 14*b*.

Figure 15:
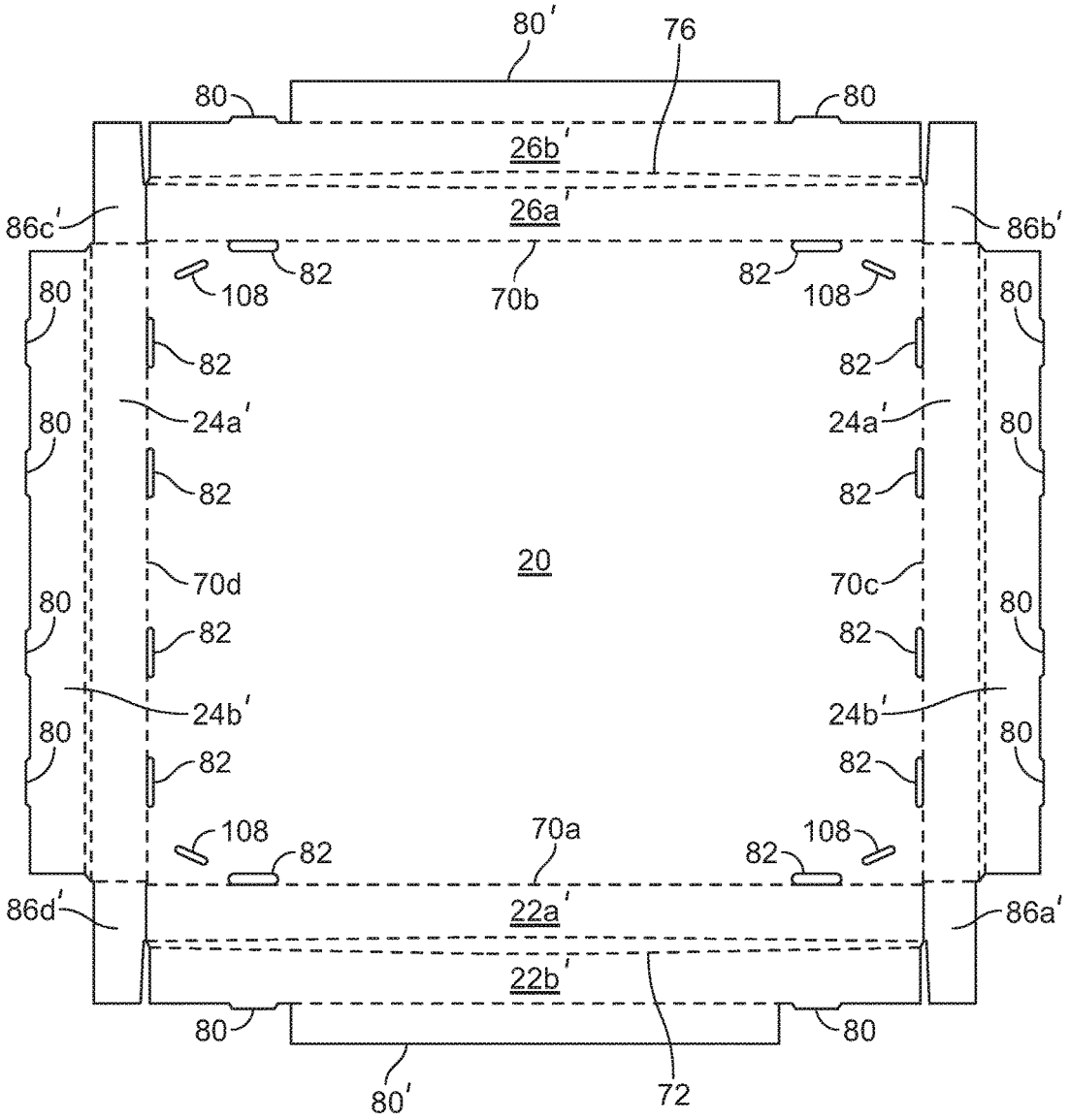
FIG. 15 is a top plan view of a blank B5 for making the base portion shown in FIGS. 14A-14F.

FIG. 15 is a top plan view of a blank B5 for making the base portion shown in FIGS. 14A-14F. This base portion 12' is similar to the base portion 12, but four angled slots 108 are added in the corner of the bottom wall 20' to enable the display trays stacked on one another. Furthermore, in blank B1, two of the locking tabs 80 in the respective outer panels 22*b*', 26*b*' are substituted with a locking tab 80' where each of which is sandwiched between the respective inner and outer panels and the tuck flaps 84*a*, 84*b*, 84*c*, 84*d* are removed. The tuck flaps 84*a*, 84*b*, 84*c*, 84*d* are now foldably extend from respective inner panels 28*a*' and 24*a*', but the base portion 12' principally functions the same as the base portion 12 depicted in FIG. 10. The stacking tabs 104 are inserted into the angled slots 108 of the base portion 12' so that the display trays are securely attached to one another. However, one of ordinary skill in the art would appreciate that the claimed invention is not limited to the aforementioned base portions described herein and various style of base portion can used as well. In fact, any such elements or features in the claimed invention can be implemented in a number of ways, as will be apparent to a person skilled in the art after reviewing the present disclosure, beyond any examples shown in this document.

Figure 16:
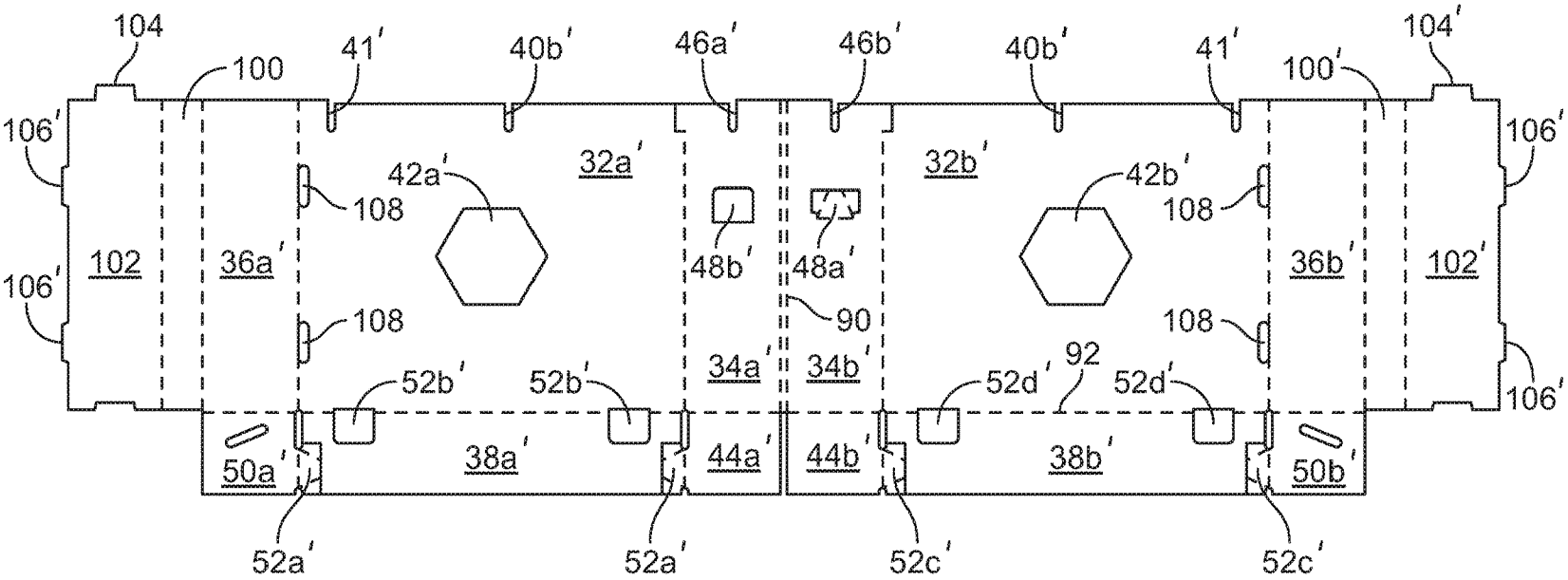
FIG. 16 is a top plan view of a blank B6 for making the respective E-shaped vertical columns shown in FIGS. 14A-14F.

FIG. 16 is a top plan view of a blank B6 for making the respective E-shaped vertical columns 14*a*', 14*b*' shown in FIGS. 14A-14F in accordance to the second embodiment of the invention. The respective E-shaped vertical columns 14*a*', 14*b*' are slightly modified with respect to the first embodiment of the invention. Each of the two arm panels 36*a*', 36*b*' is fortified with two panels 100' and 102' foldably joined to the respective arm panels 36*a*', 36*b*'. Each of the panels 102' further includes spaced-apart locking tabs 106' and stacking tabs 104'. The locking tabs 106' are engaged with the corresponding slots 108 so that a triangular gusset 103 is formed in the corner of the pallet-sized display tray 10.

While the invention has been described and illustrated with reference to one or more preferred embodiments thereof, it is not the intention of the Applicants that the invention be restricted to such detail. Rather, it is the intention of the Applicants that the invention be defined by all equivalents, both suggested hereby and known to those of ordinary skill in the art, of the preferred embodiments. For example, the pallet size may be changed so that it contains different number of bridges or the size of vertical columns may be changed so that it corresponds to the size of the product contained therein. Moreover, the geometry of the two arm panels may be changed so that it can carry more weight at the corners of the bridges. The locking tabs and attachments of the panels to one another may configured differently so as to correspond to the retailer demands.

What is claimed is:

1. A pallet-sized shipping and display tray comprising:

a base portion having opposed ends;

respective spaced-apart first and second vertical columns each of which being configured to be positioned in the opposed ends of the base portion wherein each of the respective spaced-apart first and second vertical columns includes two shoulder panels, two coterminous spine panels, and two arm panels all of which are foldably joined to one another; and at least one deck configured to be attached to the respective spaced-apart first and second vertical columns to form a bridge wherein the at least one deck comprising a supporting panel having two side depending flanges and two end depending flanges all of said side depending flanges and end depending flanges being foldably joined to one another so as to adequately support a weight of one or more upper display trays when being stacked upon one another.

2. The pallet-sized shipping and display tray of claim 1 wherein each of the respective shoulder panels includes a respective foot flap which is foldably joined thereto and each extends outwardly from respective bottom of the shoulder panels.

3. The pallet-sized shipping and display tray of claim 1 wherein each of the two coterminous spine panels includes first foot flanges each of which foldably extends from respective lateral edges.

4. The pallet-sized shipping and display tray of claim 1 wherein the two spine panels are coextensively folded and are attached to one another via a first locking tab and a first slot.

* * * * *